US005292609A

United States Patent [19]

Yoshikawa et al.

[11] Patent Number: 5,292,609

[45] Date of Patent: Mar. 8, 1994

[54] ELECTROPHOTOGRAPHIC DEVELOPER HAVING DIFFERENT POLYOLEFIN WAXES

[75] Inventors: Yuzaburo Yoshikawa; Toshiaki Yamauchi; Toshiyuki Oba; Akira Takano, all of Yokohama, Japan

[73] Assignee: Kabushiki Kaisha Toshiba, Kawasaki, Japan

[21] Appl. No.: 856,660

[22] Filed: Mar. 24, 1992

[30] Foreign Application Priority Data

Jun. 4, 1991 [JP] Japan ..... 3-133033

[51] Int. Cl.[5] ..... G03G 9/097

[52] U.S. Cl. ..... 430/110; 430/111

[58] Field of Search ..... 430/110, 111

[56] References Cited

U.S. PATENT DOCUMENTS 5,051,331 9/1991 Sakashita ..... 430/110

FOREIGN PATENT DOCUMENTS 8151 1/1981 Japan ..... 430/111
215659 12/1983 Japan ..... 430/111
252360 12/1985 Japan ..... 430/110
62-195683 8/1987 Japan .
1-85558 7/1989 Japan ..... 430/110
2-2578 1/1990 Japan .

*Primary Examiner*—Roland Martin
*Attorney, Agent, or Firm*—Foley & Lardner

[57] ABSTRACT

The developing agent comprises a colorant and vinyl-based polymer synthetic resin to which polyolefin waxes having softening points different from each other are added. Due to this softening point difference, the solidification time period for the waxes after fixation is prolonged; therefore the developing agent attains good fixation and anti-offset properties without deteriorating the preservation property and the fluidity of the developing agent.

6 Claims, 1 Drawing Sheet

ELECTROPHOTOGRAPHIC DEVELOPER HAVING DIFFERENT POLYOLEFIN WAXES

BACKGROUND OF THE INVENTION

1. Field of the Invention

The present invention relates to an electronic photograph developer, more specifically to that used in a heat depositing method.

2. Description of the Related Art

In general electric photograph copying devices, toner is applied on a latent image on the photosensitive drum to form a visible image from the latent image. This visible image is transferred on a piece of transfer paper or the like, and then fixed thereon to obtain a copy image. There are two techniques, heat and press fixings to fix a transcription image. The heat roller fixing technique, in which toner is melted by its heat and then fixed on a sheet, is widely used.

This heat roller fixing technique, however, includes the problem of a so-called offset phenomenon, in which fogging is created on the image-transcribed material by toner attached thereonto from the surface of the heat roller. This offset phenomenon can be divided into low-temperature and high-temperature offsets. The low-temperature offset occurs when toner is not completely fixed onto the sheet because of a fixing temperature, which is insufficiently low. The high-temperature offset occurs when the internal cohesive force in the melted toner becomes weaker than the adhering force working between the fixing roller and the sheet.

Covering the roller surface by a material having a toner-releasing property, such as fluorine-contained resin, or silicon, or applying a toner-releasing material such as silicon oil on the roller surface, has been considered to prevent the high-temperature offset. However, these techniques is not free from problems of durability, i.e. deterioration of the material caused by continuous use at a high temperature.

In the meantime, the technique of assigning the anti-offset property to toner itself has been considered, and more specifically, addition of another material composed of a substance insoluble to the resin to the toner as a component thereof, as is described Pulished Unexamind Japanese Patent Application 2-2578, has been proposed. However, if such an insoluble material is excessively add to enhance the anti-offset property, the toner becomes too cohesive at a high temperature. As a result, supply of toner from a container such as the toner hopper, will be very difficult. Further, if the fluidity of toner is lowered, the toner is not sufficiently stirred in the developer, suppressing charging on the toner. Such an uncharged toner is likely to cause fogging on an image, and is scattered in the copying device.

SUMMARY OF THE INVENTION

If a substance insoluble to resin is excessively added to conventional electric photograph developing agents for the purpose of enhancing the anti-offset property of the developing agents, the keeping property and fluidity of the developing agents are degraded, thereby deteriorating the quality of an image.

The present invention has been proposed as a solution to this problem, and the purpose thereof is to provide an electric photograph developing agent having excellent properties in terms of anti-offset, conservation, fluidity, and fixation.

According to the present invention, there is provided a developing agent comprising: a first polyolefin wax having a first softening point; a second polyolefin wax having a second softening point different from the first softening point; a vinyl-based polymer synthetic resin mixed with the first polyolefin wax and the second polyolefin wax.

The first polyolefin wax is blended into the polymer synthetic resin during polymerization step to form it and the second polyolefin wax is blended thereinto during molten-kneading step after polymerizing. One of the first and second polyolefin waxes is a high-softening-point one having a softening point in the range of 102°-170°, and the other is a low-softening-point one having a softening point of 2°-20° lower than that of the high-temperature softening point, and in the range between 100°-168°.

The developing agent of the present invention contains waxes having softening points different from each other; therefore, upon forming an image, the solidification time period of the waxes contained in the developing agent, which is gradually cooled after fixation, is prolonged, providing enough time for the wax to exude out on the surface of applied developing agent. Thus, a great fixation property can be obtained with this developing agent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Figure 1:
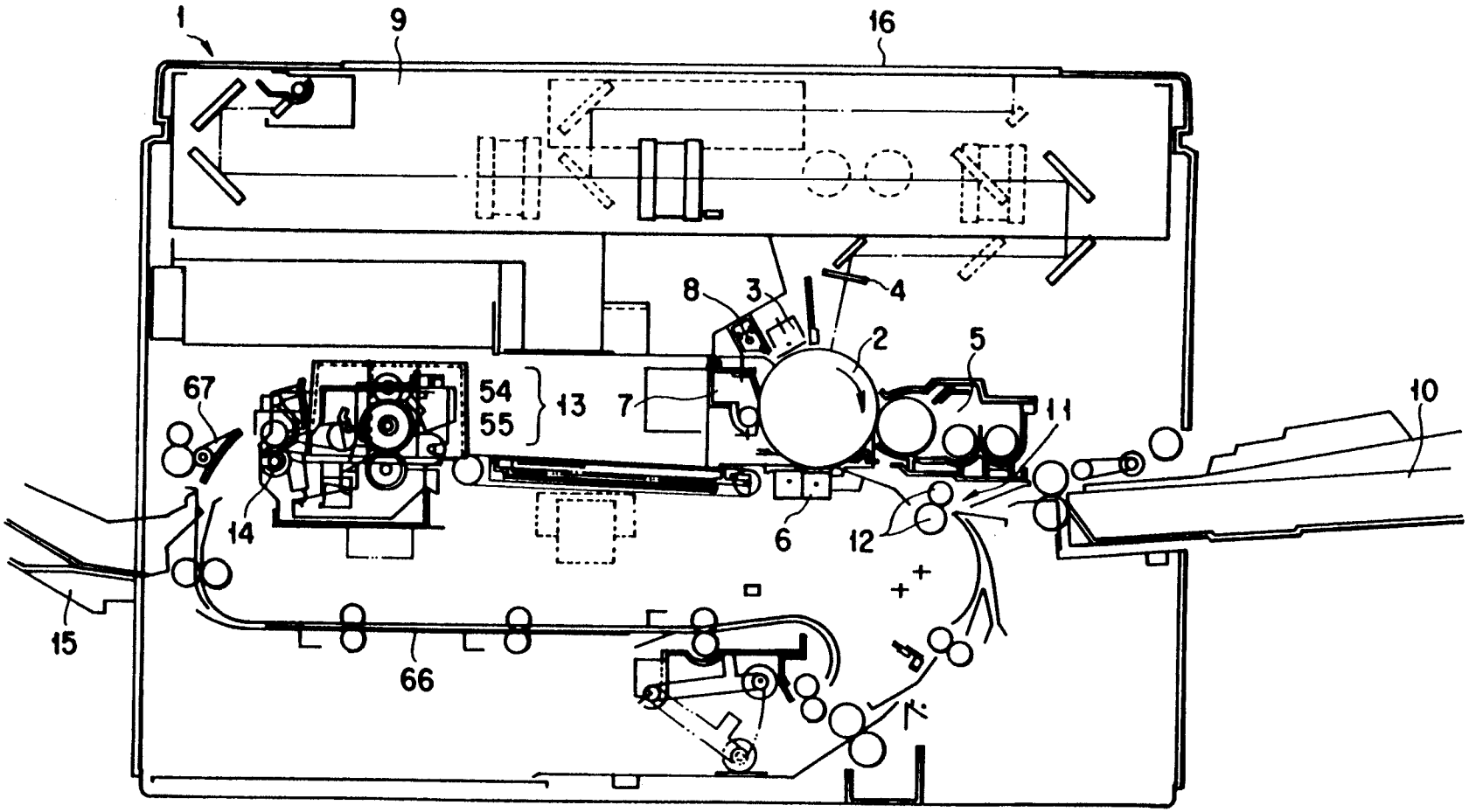
FIG. 1 is an example of the image forming device, for which the developing agent according to the present invention can be employed.

The developing agent of the invention comprises a colorant, two kinds of polyolefin waxes having softening points different from each other, and vinyl-based polymer synthetic resin.

One of the two kinds of waxes is blended into a vinyl-based polymer synthetic resin source during polymerizing step to form the synthetic resin, and the other is blended thereinto during molten-kneading step after the polymerizing step. Here, let us name the waxes blended into the synthetic resin during polymerization, and molten-kneading, as the first and second waxes, respectively. The first wax has a first softening point, and the second wax has a second sofening point different from the first softening point. One of the first and second waxes is a high-softening-point one having a softening point in the range of 102°-170°, and the other is a low-softening-point one having a softening point lower than that of the high-temperature softening point by 2°-20°, and in the range between 100°-168°.

The first and second waxes are of one kind selected from the group consisting of polypropylene and polyethylene.

The softening points of these waxes should fall in the range of about 100°-170°. Waxes with the softening points of less than 100° have poor conservation properties, very likely causing a blocking, whereas those with the softening points of 170° C. or higher, do not dissolve even if heated, making it difficult to penetrate between the fibers of the transcription sheet in a fixation step.

The amounts of the high-, and low-softening point waxes added during molten-kneading and polymerization of the vinyl polymer synthetic resin, should preferably fall in the range of 0.5–10 parts by weight with respect to 100 parts by weight of the vinyl polymer synthetic resin. If the amounts of waxes added are less than 0.5 parts by weight, the fixation tends to be degraded, whereas if they exceed 10 parts by weight, the fluidity will be lowered.

Addition of the high-, and low-softening-point waxes into the polymer synthetic resin must be separately carried out during the polymerization and kneading. If both waxes are added to the synthetic resin during the polymerization thereof, the resin mixture obtained tends to bleed during the molten-kneading. Especially, in the case where the amount of the waxes added to 100 parts by weight of the developer exceeds 10 parts by weight, it tends to have the problem of bleeding. Developing agent containing a bleeding resin mixture is partly adhered to the drum, and this adhered portion causes filming.

Further, if both waxes are added at the same time to the synthetic resin while the resin is molten-kneaded with a colorant, the fluidity, and conservation property of the developing agent are tend to decrease. Such a developing agent has a poor charge characteristic, and when used for forming an image, tends to create fogging. Again, especially, in the case where the amount of the waxes added to 100 parts by weight of the developing agent exceeds 10 parts by weight, this undesirable tendency is further grown.

In the present invention, though 10 parts by weight of each of the waxes is separately added during the polymerization and molten-kneading, that is, total of 20 parts by weight of wax is added, bleeding does not occur in the resin mixture during the molten-kneading. Meanwhile, the developing agent containing this resin mixture exhibits a good fluidity and conserving property. Thus, in the invention, one of the high-, and low-softening-point waxes is added to the synthetic resin during the polymerization, and the other wax is added during the molten-kneading.

It is preferable that the high-softening-point one is used as the first polyolefin wax. It means that the high-softening-point wax should be added to the synthetic resin during the molten-kneading, and the low-softening-point one should be added during the polymerization.

Further, the amount of the low-softening-point wax added should preferably be larger than that of the other, and more specifically, the content of the low-softening-point wax should preferably be 50–87.5 parts by weight with respect to 100 parts by weight of the total wax.

The difference between the softening points of the two kinds of waxes is 2°–20°. Use of waxes having softening points different from each other prolong the solidification time period of the waxes contained in the developing agent, which is gradually cooled after fixation, upon forming an image, providing enough time for the wax to exude out on the surface of applied developing agent. Thus, a great fixation property can be obtained by using this developing agent. If the difference is less than 2°, in other words, the softening points of the two kinds of waxes are too close to each other, the waxes are solidified too quickly to exude out on the surface of the applied developing agent. As a result, shortage of wax occurs on the surface of the applied developing agent after fixation, deteriorating the anti-abrasion property of the developing agent. On the other hand, if the difference is greater than 20°, in other words, the softening points of the two kinds of waxes are too far from each other, too much of the low-softening-point wax is melted while heating the developing agent up to the temperature at which the high-softening-point wax starts to melt down in the fixation process, resulting in poor anti-offset.

The amount of the resin mixture containing such waxes should preferably be, with respect to 100 parts by weight of the developing agent, about 70 to 95 parts by weight.

Some of the examples of vinyl-based resin as the origin of the vinyl-based polymer synthetic resin are vinyl resins such as polyvinyl butyral and polyvinyl alcohol, acryl resins such as polyacrylic acid, polymethacrylate, polyacrylate, and styrene resins such as polystyrene and polymethyl styrene.

Some of the examples used as a binder for the developing agent are styrene-based copolymers such as polystyrene, styrene-butadiene copolymers and styrene-acryl copolymer, ethylene-based copolymers such as polyethylene, ethylene-vinyl acetate copolymer, ethylene-vinyl alcohol copolymer, so-called petroleum resins such as phenol-based resin, polyamide resin, polyester resin, maleic-acid-based resin, polymethyl methacrylate, polyacrylic acid resin, polyvinylbutyral, aliphatic hydrocarbon resin, alicyclic hydrocarbon, and aromatic hydrocarbon, chlorinated paraffin, and mixtures thereof. Especially, at least one styrene-based resin should be selected from the group consisting of polystyrene, styrene-butadien copolymer, and styrene-acryl-based copolymer.

Some of the examples of popular colorants which can be used for the developing agent are carbon black, fast yellow G, benzidine yellow, pigment yellow, indo fast, orange, irgadine red, carmine FB, permanent bordeaux FRR, pigment orange R, lithol red 2G, lake red C, rhoda-mine FB, rhodamine B lake, phthalocyanine blue, pigment blue, brilliant green B, phthalocyanine green, and quinacridone.

Further, for the purpose of controlling the amount of charge given by carrier particles, a metal-dye-based, nigrosine-based, or polyamine-based static-controlling agent may be used. These static-controlling agents can be mixed into nuclear toner and/or surface treating agent when used.

Furthermore, to improve the fluidity of anti-cohesive property of the colorant particles, colloidal particles such as colloidal silica which is subjected to hydrophobic treatment and the same polarity as that of the colorant can be added to the developing agent.

Improvement of the fluidity of the colorant and stabilization of the charge amount can be achieved by not only colloidal silica, but also inorganic oxides such as aluminum oxide, titanium oxide, silicon oxide, zinc oxide, magnesium oxide, calcium oxide, tin oxide, silicon, indium oxide, cerium oxide, molybdenum trioxide, and inorganic oxides, the surface of each of which is treated by couplers such as silane coupler and titanium coupler or by silicon oil, styrene-based copolymers such as polystyrene, styrene-butadien copolymers, styrene-acryl copolymers, aliphatic copolymers such as polyethylene, ethylene-based copolymers, and polymethyl methacrylate, alicyclic copolymers, fine-powdered resins such as silicon resin and teflon, fine-powdered resins, the surface of each of which is treated by couplers, silicon oil or the like, and magnetic powder such as magnetite and ferrite.

It should be noted here that the polarity of charge on the developing agent of the invention is not regarded, i.e. positive or negative.

In the present invention, the 50%-volume average grain diameter of the developing agent should be 5–20 μm. If the average grain diameter is smaller than 5 μm, the fluidity is significantly lowered, resulting in imperfect images due to lack of density. On the other hand, the fact that the average diameter is larger than 20 μm, means that the developing agent contains, in ratio, a large amount of coarse grains whose grain diameter is 30 μm or more. Coarse grains is difficult to charge, as a result, the ratio of the low-charge portion rises in the developing agent, increasing fogging of images. Practically, the content of coarse grains having diameters of 30 μm or more should preferably be no more than 5 weight % of the total amount of the developer. Further, the ratio of 50%-number average grain diameter to 50%-volume average grain diameter should be 0.5 or higher. The ratio which is less than 0.5 indicates a wide grain size distribution, in which the fine powder grains and coarse grains increase in amount, creating defects such as dust and fogging on images.

In the meantime, the glass transition point of the developer should be in the range of 40°–70° C. If the transition point is lower than 40° C., the preservation and fixation properties are deteriorated, whereas if it exceeds 70° C., a poor fixation property results in spite of a good preservation property.

The developing agent of the invention can be prepared by grinding a molded ordered mixture made of nuclear toner premixed with a saturated or unsaturated fatty acid and a surface-treating agent containing vinyl-based polymer resin. Here, to prepare the nuclear toner, developer components containing, for example, coloring agent, fluidizing agent, and binding agent, are blended, grinned and classified. The ordered mixture is nuclear toner whose surface is covered with a surface-treating agent, and can be prepared by an O. M. DIZER.

In the developing agent of the invention, one of a high-softening-point polyethylene or polypropylene wax having a softening point in the range of 102°–170°, and a low-softening-point polyethylene or polypropylene wax having a softening-point lower than that of the high-softening-point wax by 2°–20° C., i.e. a softening point in the range of 100°–168° C., is added during polymerization of vinyl-based polymer synthetic resin, and the other is added during molten-kneading of the obtained synthetic resin, a colorant, and a charge controller. As described, the developing agent of the invention contains two kinds of waxes having softening points different from each other; therefore the time period from start of solidification of the wax to its completion while cooling the developing agent after fixation, is longer in the case of the present invention than the case where only one kind of wax is employed. That is, the time period for the wax contained in the developing agent staying in a liquid state is prolonged, increasing the amount of wax exuded out on the surface. Consequently, toner having a high separability against the fixing roller, excellent anti-abrasion and anti-offset properties, and good fixation property can be obtained.

Despite that two kinds of waxes having softening points different from each other are employed, if they are added to a developing agent during polymerization of the resin or molten-kneading at the same time, the developing agent give rise to toner containing wax having a poor dispersion property, deteriorating the fluidity and the preservation property of the developing agent.

To prolong the time period during which the wax in the developing agent stays a liquid state in the case where only one kind of wax is employed, the fixation system should be designed to be of high quantity of heat. However, such a fixation system degrade the anti-offset property.

The above are the reasons for adding one of waxes having softening points different from each other during one of polymerization of the resin and molten-kneading, and the other during the other process, separately.

The developing agent of the invention can be applied for various kinds of image forming apparatus. FIG. 1 is a brief diagram of the basic structure of an example of copying devices for which the developing agent of the invention can be applied.

As can be seen in FIG. 1, a photosensitive member 2, which serves as an image carrying member, is provided at about the center of a copying device 1 rotatably in the direction indicated by the arrow. Around the photosensitive member 2, electrostatic charger 3, slit glass 4, developing device 5, transcription charger 6, cleaner 7, and discharger 8, are arranged in the mentioned order. The copying device 1 has an optical system 9 for exposing original sheets in its upper portion, whereas the device has a paper-feeding cassette 10 set to the lower portion thereof. Sheets are supplied from this cassette 10, and carried along a carrying path 11, on which arranged are a resist roller 12, fixing device 13, and paper-discharging roller 14 in the mentioned order along the paper-carrying direction. FIG. 1 also depicts a discharged paper tray 15, and an original sheet base 16.

The transcription process in a copying machine of the above-mentioned type proceeds as follows:

A light beam irradiated from the optical system 9 reflects on an original sheet on the sheet base 16, and the reflection beam forms an image on a photosensitive member 2 via an image-forming lens array 4 so as to form a static latent image on the photosensitive member 2. Toner powder, supplied from the developing device 5, is attached onto this formed static latent image, visualizing the static latent image.

In the meantime, a sheet supplied from the paper-feeding cassette 10 is carried between the photosensitive member 2, and transcription charger 6, and the formed visual image on the photosensitive member 2 is transcribed on the sheet. Then, the sheet is carried to the fixation device 13 consisting of the heat roller 54 and press roller 55 through the carrying path 11. After fixation, the sheet is discharged onto the discharged paper tray 15 by means of the paper-discharging tray 15. Between the paper-discharging roller 14 and the discharged paper tray 15, provided is a paper-dicharging-/paper-reversion switch gate 67. When this switch gate 67 is switched to the paper-discharging side, the sheet, after fixation, is discharged onto the discharged paper tray 15 as mentioned above, whereas when the gate 67 is switched to the other side, the sheet on one side of which an image is formed is introduced into a reversion device through the carrying path 66. In the reversion device, the sheet having an image on one side thereof is reversed, and sent back to the carrying path 11. Thus, an image is formed on the other side of the sheet.

The following are examples and comparative examples of image formation using developing agents having the specified components in a copying machine having the above-described structure.

EXAMPLE 1

| | |
|---|---|
| Styrene-acryl copolymer synthetic resin (CPR-100: Mitsui Toatsu Chemicals, Inc.) to which 5 parts by weight of polyethylene wax (Mitsui Hiwax 210P: Mitsui Petrochemical Industries, Ltd.) having the softening point of 120° C. was added during polymerization | 100 parts by weight |
| Polyethylene wax (Sanwax 131P: Sanyo Chemical Industries, Ltd.) having the softening point of 108° | 5 parts by weight |
| Carbon black (MA-600: Mitsubishi Chemical Industries, Ltd.) | 10 parts by weight |
| Charge controller (S-34: Orient Chemical Industries, Ltd.) | 3 parts by weight |

After mixing the above-listed materials all together, the mixture was kneaded for 30 minutes at about 100° using a kneader (press kneader). The mixture was crashed, and then powdered by the I-type jet mill-DS classifier. The resultant was finally subjected to wind force classification, and toner having the 50%-volume average grain diameter of 12.0 μm was obtained.

Into the toner thus obtained, ferrite carrier F-150 of Nippon Tetsufun was blended such that the density ratio thereof against the toner is 4%, to obtain a developing agent. Using this developing agent, a duplicate image was made by Toshiba Copy Machine Leodry 4810. The image obtained was clear, i.e. the image density of 1.30, and fogging of 0.1%.

Meanwhile, the fixation rate of the toner was examined in the following manner. An image was put out on an image exhibiting chart (step chart), and the image density was measured by RD-914 of Macbeth. The fixation rate was then calculated from the density-after-fastening/the density-before-fastening, and the result was 91%, with no sign of offset.

EXAMPLE 2

| | |
|---|---|
| Styrene-acryl copolymer synthetic resin (CPR-100: Mitsui Toatsu Chemicals, Inc.) to which 5 parts by weight of polyethylene wax (Mitsui Hiwax 210P: Mitsui Petrochemical Industries, Ltd.) having the softening point of 122° was added during polymerization | 100 parts by weight |
| Polyethylene wax (Sanwax 131P: Sanyo Chemical Industries, Ltd.) having the softening point of 114° | 5 parts by weight |
| Carbon black (MA-600: Mitsubishi Chemical Industries, Ltd.) | 10 parts by weight |
| Charge controller (S-34: Orient Chemical Industries, Ltd.) | 3 parts by weight |

Using the above-listed materials, toner was obtained in the same manner as in Example 1.

Into the toner thus obtained, ferrite carrier F-150 of Nippon Tetsufun was blended such that the density ratio thereof against the toner is 4%, to obtain a developing agent. Using this developing agent, a duplicate image was made by Toshiba Copy Machine Leodry 4810. The image obtained was clear, i.e. the image density of 1.30, and fogging of 0.1%.

Meanwhile, the fixation rate of the toner was examined in the following manner. An image was put out on an image exhibiting chart (step chart), and the image density was measured by RD-914 of Macbeth. The fixation rate was then calculated from the density-after-fastening/the density-before-fastening, and the result was 88%, with no sign of offset.

EXAMPLE 3

| | |
|---|---|
| Styrene-acryl copolymer synthetic resin (Uni-3500: Sanyo Chemical Industries, Ltd.) to which 4 parts by weight of polypropylene wax (biscol 550P) having the softening point of 150° was added during polymerization | 100 parts by weight |
| Polypropylene wax (biscol 660P: Sanyo Chemical Industries, Ltd.) having the softening point of 145° | 1 parts by weight |
| Carbon black (MA-600: Mitsubishi Chemical Industries, Ltd.) | 10 parts by weight |
| Charge controller (S-34: Orient Chemical Industries, Ltd.) | 2 parts by weight |

Using the above-listed materials, toner was obtained in the same manner as in Example 1.

Into the toner thus obtained, ferrite carrier F-150 of Nippon Tetsufun was blended such that the density ratio thereof against the toner is 4%, to obtain a developing agent. Using this developing agent, a duplicate image was made by Toshiba Copy Machine Leodry 4810. The image obtained was clear, i.e. the image density of 1.30, and fogging of 0.1%.

Meanwhile, the fixation rate of the toner was examined in the following manner. An image was put out on an image exhibiting chart (step chart), and the image density was measured by RD-914 of Macbeth. The fixation rate was then calculated from the density-after-fastening/the density-before-fastening, and the result was 85%, with no sign of offset.

Control 1

| | |
|---|---|
| Styrene-acryl copolymer synthetic resin (CPR-100: Mitsui Toatsu Chemicals, Inc.) to which 15 parts by weight of polyethylene wax (Mitsui Hiwax 410P: Mitsui Petrochemical Industries, Ltd.) having the softening point of 122° was added during polymerization | 100 parts by weight |
| Polyethylene wax (Mitsui Hiwax 320P: Mitsui Chemical Industries, Ltd.) having the softening point of 114° | 15 parts by weight |
| Carbon black (MA-600: Mitsubishi Chemical Industries, Ltd.) | 10 parts by weight |
| Charge controller (S-34: Orient Chemical Industries, Ltd.) | 3 parts by weight |

Using the above-listed materials, toner was obtained in the same manner as in Example 1.

Into the toner thus obtained, ferrite carrier F-150 of Nippon Tetsufun was blended such that the density ratio thereof against the toner is 4%, to obtain a developing agent. Using this developing agent, a duplicate image was made by Toshiba Copy Machine Leodry 4810. The image obtained was clear, i.e. the image density of 1.30, and fogging of 0.1%.

Meanwhile, the fixation rate of the toner was examined in the following manner. An image was put out on an image exhibiting chart (step chart), and the image density was measured by RD-914 of Macbeth. The fixation rate was then calculated from the density-after-fastening/the density-before-fastening, and the result was 88%. However, offset occurred here, and the fluidity was significantly deteriorated.

Control 2

| | |
|---|---|
| Styrene-acryl copolymer synthetic resin (Uni-3500: Sanyo Chemical Industries, Ltd.) to which 4 parts by weight of polypropylene wax (biscol 660P) having the softening point of 145° was added during polymerization | 100 parts by weight |
| Polyethylene wax (Mitsui Hiwax 320P: Mitsui Chemical Industries, Ltd.) having the softening point of 114° | 5 parts by weight |
| Carbon black (MA-600: Mitsubishi Chemical Industries, Ltd.) | 10 parts by weight |
| Charge controller (S-34: Orient Chemical Industries, Ltd.) | 3 parts by weight |

Using the above-listed materials, toner was obtained in the same manner as in Example 1.

Into the toner thus obtained, ferrite carrier F-150 of Nippon Tetsufun was blended such that the density ratio thereof against the toner is 4%, to obtain a developing agent. Using this developing agent, a duplicate image was made by Toshiba Copy Machine Leodry 4810. The image obtained was clear, i.e. the image density of 1.30, and fogging of 0.1%.

Meanwhile, the fixation rate of the toner was examined in the same manner as the other. The result was 88%, and offset occurred.

As is clear from the Examples 1–3, according to the present invention, there is provided an electronic photograph developing agent having good properties such as anti-abrasion, fixation and anti-offset.

Additional advantages and modifications will readily occur to those skilled in the art. Therefore, the invention in its broader aspects is not limited to the specific details, and representative materials, described herein. Accordingly, various modifications may be made without departing from the spirit or scope of the general inventive concept as defined by the appended claims and their equivalents.

What is claimed is:

1. A developing agent comprising:

a first polyolefin wax having a first softening point in the range between 102°–170° C.; and a second polyolefin wax having a second softening point lower than the first softening point by 2°–20° C. and in the range between 100°–168° C.;

a vinyl-based polymer synthetic resin mixed with the first polyolefin wax and the second polyolefin wax; wherein said first polyolefin wa is blended into the polymer synthetic resin during polymerization thereof, and the second polyolefin wax is blended thereinto during molten-kneading, wherein the content of each of said first and second waxes is 0.5 to 10 parts by weight with respect to 100 parts by weight of said vinyl-based polymer.

2. A developing agent according to claim 1, further comprising colorant.

3. A developing agent according to claim 1, wherein said first polyolefin wax is at least one selected from the group consisting of polypropylene and polyethylene.

4. A developing agent according to claim 1, wherein said second polyolefin wax is at least one selected from the group consisting of polypropylene and polyethylene.

5. A developing agent according to claim 1, wherein a content of said low-softening-point wax is 50–87.5 parts by weight with respect to 100 parts by weight of all the waxes.

6. A developing agent according to claim 1, wherein said vinyl-based polymer synthetic resin is at least one kind of styrene-based resin selected from the group consisting of polystyrene, styrene-butadien copolymer, and styrene-acryl-based copolymer.

* * * * *